US010399095B1

(12) United States Patent
Bobba

(10) Patent No.: US 10,399,095 B1
(45) Date of Patent: Sep. 3, 2019

(54) VANE FOR A SHOWER HEAD

(71) Applicant: Choudary Ramakrishna Bobba, Palm City, FL (US)

(72) Inventor: Choudary Ramakrishna Bobba, Palm City, FL (US)

( * ) Notice: Subject to any disclaimer, the term of this patent is extended or adjusted under 35 U.S.C. 154(b) by 0 days.

(21) Appl. No.: 15/929,056

(22) Filed: Oct. 25, 2018

Related U.S. Application Data

(60) Provisional application No. 62/584,247, filed on Nov. 10, 2017.

(51) Int. Cl.
*B05B 1/34* (2006.01)
*B05B 1/04* (2006.01)
*B05B 1/18* (2006.01)

(52) U.S. Cl.
CPC ..... *B05B 1/3405* (2013.01); *B05B 1/044* (2013.01); *B05B 1/18* (2013.01)

(58) Field of Classification Search
CPC ..... B05B 1/3405; B05B 1/044; B05B 1/18
USPC .... 239/463, 465, 487, 488, 553, 533.5, 548, 239/522, 525
See application file for complete search history.

(56) References Cited

U.S. PATENT DOCUMENTS 916,984 A * 4/1909 Bleymehl ..... B05B 1/3415 239/487
1,310,938 A * 7/1919 Ballerstedt ..... B05B 1/3431 239/465
2,458,876 A * 1/1949 Rehn ..... A61H 35/02 239/487
2,752,201 A * 6/1956 Blass ..... A01G 25/023 239/552
3,104,829 A 9/1963 Wahlin
5,232,165 A 8/1993 Tournier

* cited by examiner

*Primary Examiner* — Steven J Ganey
(74) *Attorney, Agent, or Firm* — Kintner IP, LLC; Mary Frances Ludwig

(57) ABSTRACT

An atomizing and vortex generating vane for cooperation with a nozzle of a shower head includes a cylindrical body having a central longitudinal axis and a vane blocker centered about the axis. The vane blocker has a cross-sectional profile rotated about the axis in a helical path from top to bottom, forming helical flow boundary walls. Fluid flows through flow paths defined by the flow boundary walls, in a swirling path around the central longitudinal axis. A splash nozzle including the vane generates fluid jets ranging from full cone to the hollow cone fluid jets, for showering purposes. A shower head including a storage tank and a plurality of the splash nozzles is designed to conserve water while providing a warm and comfortable shower experience.

16 Claims, 11 Drawing Sheets

VANE FOR A SHOWER HEAD

CROSS-REFERENCE TO RELATED APPLICATION

This application claims the filing benefit under 35 U.S.C. § 119(e) of U.S. Provisional Application No. 62/584,247, filed 10 Nov. 2017, which is hereby incorporated by reference.

TECHNICAL FIELD

The invention relates generally to the field of bath and shower systems. More specifically, the invention relates to vorticity generating elements and atomizing elements, also called splash vanes, and shower heads incorporating the same.

BACKGROUND OF THE INVENTION

Shower heads generally include a plurality of nozzles to provide a shower of water droplets over a large area of a user's body. It is generally desired that a shower head provide the following: efficient wetting of maximum body, sufficient pressure to wash soap suds off the body, a comfortable feel of the droplet spray on impact with the body, and conservation of water.

Spray nozzles with generic vanes are widely used in the agricultural field for spreading water, fertilizers, and pesticides. Such spraying is often performed over large tracts of land, and farmers desire to use conservative methods to dispense the fertilizers and pesticides in an efficient and economical manner. Agricultural spray nozzles use atomization techniques to break up the flow of fluids into smaller droplets, enabling the coverage of wider areas of farm land. When the droplet is too small, for instance less than 150 microns in diameter, it then becomes a misty fog and drifts away from the area that needed to be treated. Indeed one needs to be careful not to be anywhere close to such drifting, fogging, and clouding conditions.

Spray nozzles with vanes are also used widely for tank cleaning, auto wash facilities, driveway cleaning and other high-pressure applications. For such applications a higher impact force of the droplets from the liquid jet on the contact surface that is being cleaned becomes significantly important.

Spray nozzles and vanes developed for the above applications fall short of meeting the needs of bath systems, and there is clear need for an improved system that addresses this complex and challenging problem. The small droplet sizes preferred in agricultural spraying and the high droplet impact forces of pressure cleaning systems are inappropriate for shower systems. In addition, the temperature characteristics of the droplet spray are critical in showering applications, but generally have no relevance to agriculture and cleaning applications.

To apply such technology to shower heads, one has to be cognizant of the heat transfer characteristics of the water droplets and their dependence on the size of the droplets. The larger the droplet the more the mass and higher the heat flux it can hold (heat flux, Q, is defined as the amount of heat contained in the mass of material Q=mass*specific heat of the fluid*Delta T, where Delta T is the temperature difference between the inlet temperature of the jet and the ambient temperature). As the water exits from the shower head it exchanges heat with the surrounding ambient air by convection from its surface area and the bather by conduction.

The larger the surface area of the droplet the greater the heat loss. Also, as a large droplet is split into large number of small droplets, the total surface area of all such smaller droplets increases, resulting in larger heat loss through convection at their surfaces. The smaller the droplet the smaller the heat flux in it and larger the heat loss. Also, the larger the droplet size the higher the heat flux in the droplet. In other words, for the same amount of flow from a shower head, larger droplets retain more heat than smaller droplets and cover lesser area to wash, whereas smaller droplets cover larger area to wash and loses more heat than the larger droplets. These two opposing properties of the droplet sizes require careful attention in selecting the droplet size to achieve the satisfactory performance from the shower head.

BRIEF SUMMARY OF THE INVENTION

The vane for a shower head described herein provides a splash spray capable of delivering a warm and comfortable shower experience while also conserving water. Embodiments of the atomizing and vortex generating element, also referred to herein as a splash vane or vane, can generate a class of conic fluid jets varying from full cone fluid jets to hollow cone fluid jets with various dispersion angles of the exit jets. Embodiments provided give the designer a unique capability to design conic fluid jets with variable droplet density and diameter that can be used in many applications meeting the challenging property requirements including the heat transfer requirements. In this invention the methodology adopted comprises a qualitative investigation to find a splash vane mechanism that yields the desired characteristics of a droplet and its heat transfer properties for shower head applications. The splash vane geometry should be small enough to be accommodated in a small splash nozzle body needed to conserve the water.

The splash spray shower head, also referred to as a shower head, includes a shower head body with a fluid inlet connected to a supply tank which holds and distributes the fluids to a plurality of splash nozzles. The splash nozzles, also referred to as nozzles, are held by a nozzle holding plate, which may be an integral part of the shower head. A plurality of splash vanes are inserted in nozzles, and may be used with retaining rings. The splash vane has a substantially cylindrical body with a central longitudinal axis extending from a top face to a bottom face. A vane blocker is centered about the central longitudinal axis, as has a cross-sectional profile orthogonal to the central longitudinal axis. The shape of the solid body of the vane blocker includes the cross-sectional profile rotated about the central longitudinal axis in a helical path from the top face to the bottom face, and forms a plurality of helical flow boundary walls. These flow boundary walls define a plurality of flow paths. Each flow path has a vane opening at both the top face and the bottom face so that fluid may flow from the top face to the bottom face in a swirling path around the central longitudinal axis.

Fluid enters the shower head at its inlet and is distributed to the plurality of nozzles that are held in a water tight manner by the nozzle holding plate. A vigorous forced rotational motion is imparted to fluid entering the nozzles by the plurality of swirling flow paths of the splash vane. Fluid exits the vane with a large vorticity coupled with high intensity turbulence. Fluid impinging on the inner walls of the nozzle undergoes atomization. These properties of vorticity, rotational motion, turbulence, and atomization cause the fluid to exit in a conical jet form with significant dispersion angles. Without the presence of the splash vanes, the fluid would have exited the nozzles in a string-like laminate form with no dispersion at all.

DETAILED DESCRIPTION OF THE INVENTION

Figure 1A:
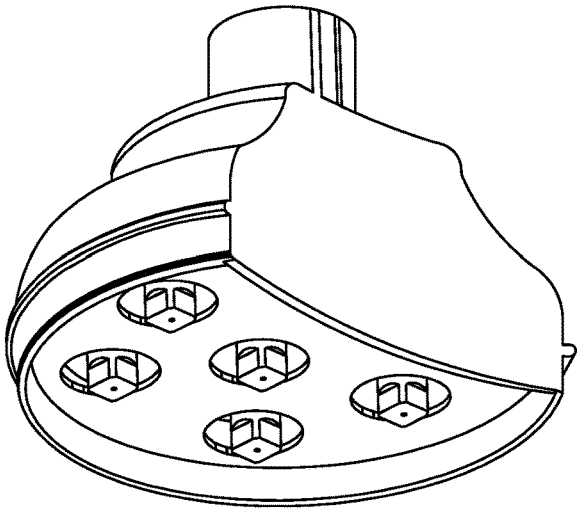
FIG. 1A is a perspective view of a splash spray shower head.
Figure 1B:
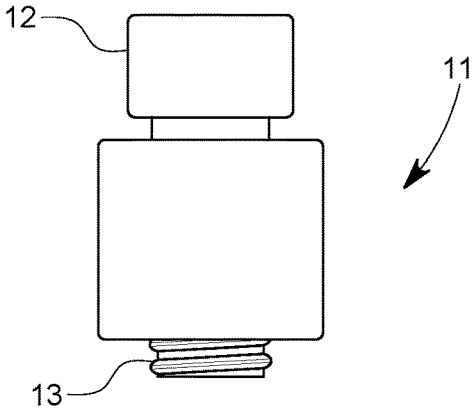
FIG. 1B is a plan view of a connector for use between the shower head and a water supply.
Figure 2:
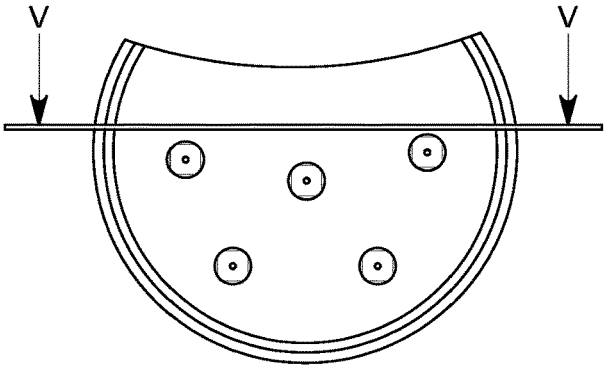
FIG. 2 is a plan view of the shower head.
Figure 3A:
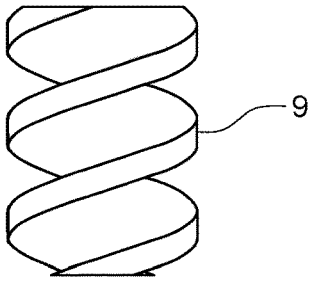
FIG. 3A is an elevation view of an embodiment of a splash vane.
Figure 3B:
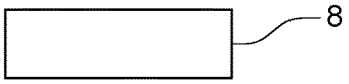
FIG. 3B is an elevation view of a retaining ring.
Figure 3C:
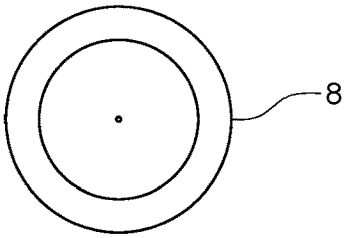
FIG. 3C is a plan view of the retaining ring.
Figure 4:
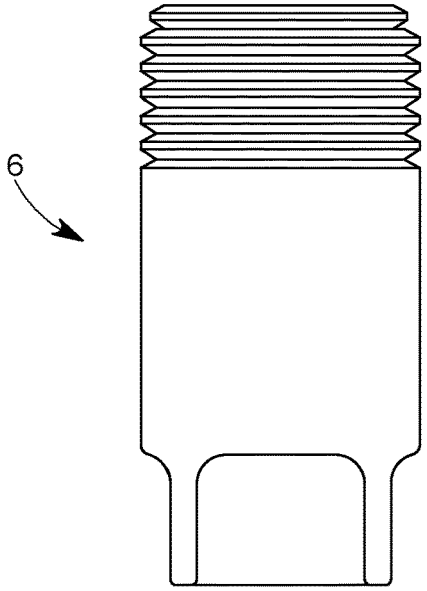
FIG. 4 is an elevation view of an embodiment of a splash nozzle.
Figure 5:
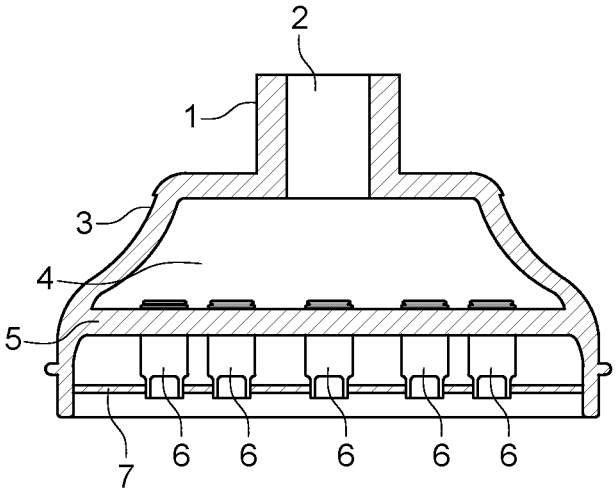
FIG. 5 is a cross-sectional view along line V-V of FIG. 2.

Referring initially to FIGS. 1A, 1B, 2, 5, & 19, there are shown embodiments of a splash spray shower head including the following components: a straight connector to swivel ball connector 1, configured to connect the shower head to a rotating ball swivel connector 11; a water inlet 2 through which water enters the shower head; a shower head body 3; a supply tank 4 in fluid communication with inlet 2; a plurality of nozzles 6 connected to a nozzle holding plate 5; and a plurality of splash vanes 9 each inserted into a nozzle 6, and which may be used in conjunction with a retaining ring 8.

Rotating ball swivel connector has a connecting end to main water supply 12, configured for connection to the water supply line in the household. The straight connector to swivel ball connector 1 of shower head body 3 is connected to connecting end to the shower head 13 of rotating ball swivel connector 11 in a secure fashion which provides the flexibility in positioning the shower head.

Splash nozzles 6 are each fitted with an atomizing and vortex generating element also known as turbulence and swirl generating splash vane 9. Nozzles 6 are securely fastened to nozzle holding plate 5 and positioned and configured to spray fluid through a plurality of holes in a bottom plate 7 of the shower head. Bottom plate 7 may be an integral part of the shower head body 3. The plurality of holes in the nozzle holding plate 5 and those in the bottom plate of shower head 7 are aligned to properly to insert and hold the splash nozzles securely to the nozzle holding plate 5. All parts of the assembled shower head are secured in a water tight fashion.

The shown embodiment includes five splash nozzles 6 and five splash vanes 9. Embodiments are presented wherein the splash vanes may or may not include a retaining ring 9. Several embodiments of splash nozzles and splash vanes can be arranged to serve the same purpose of this application. The embodiment of the shower head presented in this invention is very flexible and can be scaled to fit many a specific needs as a situation warrants. Notice this splash spray shower head is quite different from the conventional round bottomed shower heads where the water outlets, the nozzles, are usually placed in a symmetric circular manner. As seen in FIG. 1A, this splash spray shower head is non-circular; and has a portion which has been hollowed out. The nozzles are placed in approximately a half-circular portion of the shower head, to deliver the water in an efficient manner to the bather, consistent with the purpose of conserving fluids.

With reference again to FIG. 5, fluid enters the shower head at water inlet 2 and fills the shower head supply tank 4. In this description the word 'water' may be understood to encompass fluids or solutions suitable for passage through a spray head. The pressure in the supply tank is very close to that of the total or stagnation pressure of the source to the shower head. The water at this high pressure then enters splash nozzles 6. The two key elements of the splash spray shower head are: 1. a splash nozzle that dispenses the designed amount of fluid flow to conserve water; and, 2. the unique splash vane that controls the dispersion angle of the exit jet from the nozzle, and thereby the droplet size of the exiting fluid jet.

Figure 6:
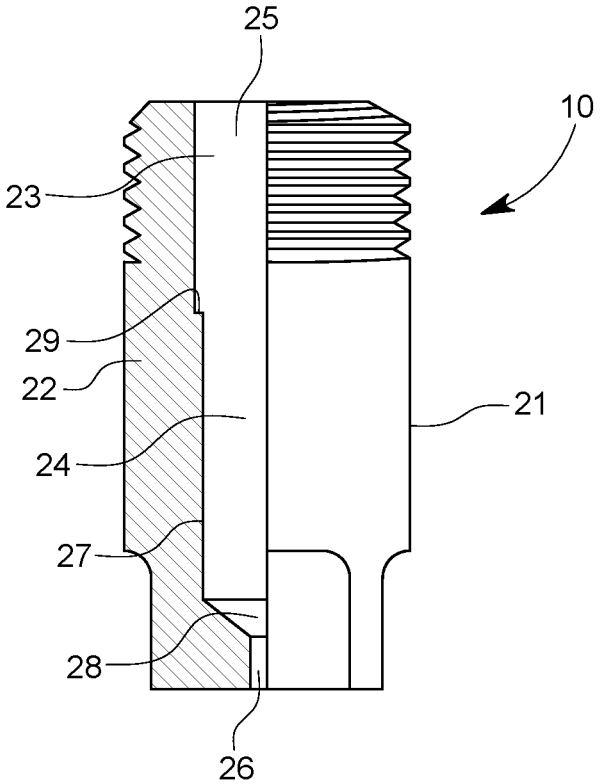
FIG. 6 is a partial cross-sectional view of the FIG. 4 embodiment of the splash nozzle.
Figure 12:
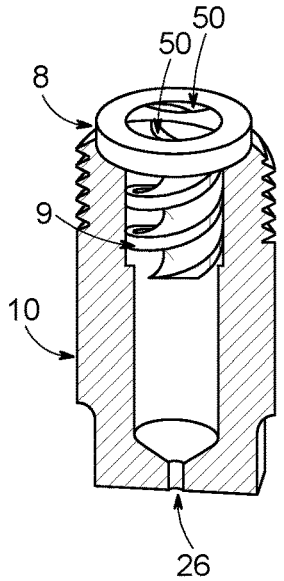
FIG. 12 is an elevation view of an assembly of a splash vane and splash nozzle with retaining ring.
Figure 13:
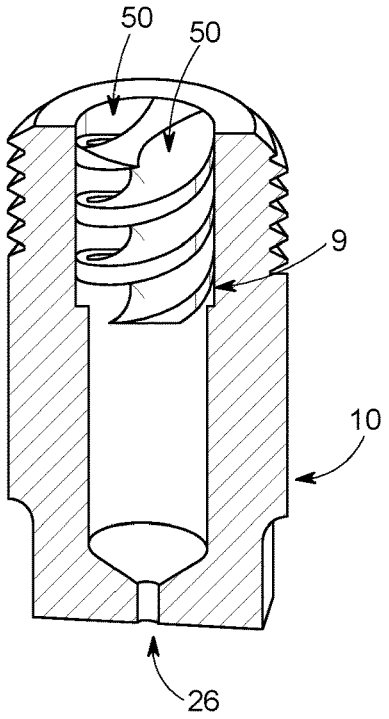
FIG. 13 is an elevation view of an assembly of a splash vane and splash nozzle without retaining ring.

Referring to FIGS. 6, 12, & 13, there are illustrated components of splash nozzle 6 and splash vane 9. Water that enters nozzle 6 is subjected to vortex or simultaneous linear and rotational motion by the geometry of splash vane 9 in vane chamber 23 of the nozzle. The rotating fluid leaves the splash vane at its bottom, and is then splashed tangentially against a nozzle inner wall 27 and enters a swirling chamber 24 of the nozzle with high rotational motion. In swirling chamber the rotational flow from the two opposite sides of the splash vane mixes together and exits through the nozzle exit with varying degrees of dispersion angles depending on the pressure of the fluid in the splash nozzle and geometry of the splash vane. The geometry of the nozzle exit also will have a significant effect on the exit properties of the exiting fluid jets from such nozzles. It should be noted here that the user has the ability to change the pressure of the water supply to the shower head by operating the shut-off valves of the main fluid supply to the bathing system. The splash vane experiences the changes in supply pressure and responds by changing the character of the jet spray dispersion angles and thereby the droplet sizes, providing a warm and comfortable shower experience to bather.

The design process and the performance of these the splash nozzle and splash vane are described below.

The Splash Nozzle

The splash nozzle 10 is a device that ejects liquid droplets in a spray form. The details of geometry and flow paths of an example splash nozzle 10 are shown in the FIG. 6. Embodiments of the splash nozzle comprise a hollow cylindrical body with a wide flow inlet area for the liquid flow to enter (flow entrance 25), and a very small exit area for the liquid to exit (nozzle exit 26).

Fluid enters splash nozzle 10, with a splash vane 9 inserted in it (see, e.g., FIG. 12), at flow entrance 25 through vane opening 50, flows through the vane chamber 23 subjected to rotational motion in the vane chamber by a splash vane 9, a vortex generating and atomizing element. It then passes through the swirling chamber 24 of the nozzle and expands to ambient pressure through the nozzle exit 26. Such an expansion, coupled with the vortex motion of the fluid in the vane chamber and swirling chamber of the splash nozzle, renders the exiting flow from the splash nozzle to a conical fluid jet having a dispersion angle dependent on the pressure and the geometry of the splash vane in the splash nozzle.

The splash nozzle 10, shown in FIG. 6, comprises an outer cylindrical body enclosed by nozzle outer wall 21 with a hollow cylindrical inner body. A vane chamber 23 and a swirl chamber 24 are located in the hollow cylindrical inner body of the splash nozzle. At the end of the vane chamber 23 a step or ledge, called vane stopper 29, is provided between vane chamber 23 and swirling chamber 24, creating a reduction in cross-sectional area from the vane chamber to the swirling chamber, and providing a step for the vanes to sit on without dropping into the swirling chamber. At the end of the swirling chamber a conical transition passage, referred to as flow contraction area 28, connects the swirling chamber to the nozzle exit 26. The nozzle exit 26 comprises a passage with a small diameter for the fluid to exit from the nozzle.

The inlet pressure of the fluid and the exit diameter 26 of the shower head splash nozzle control the flow rate from the splash nozzle and thereby the flow rate of the shower head. The splash vane, by virtue of its geometry and its position in the flow path of the fluid, controls the inlet and exit angles of the fluid flow, the turbulence levels of the flow, the atomization of the fluid in the splash nozzle, the dispersion angle of the fluid jet exiting the splash nozzle, and thereby the droplet size of the exiting fluid jet.

Figure 7:
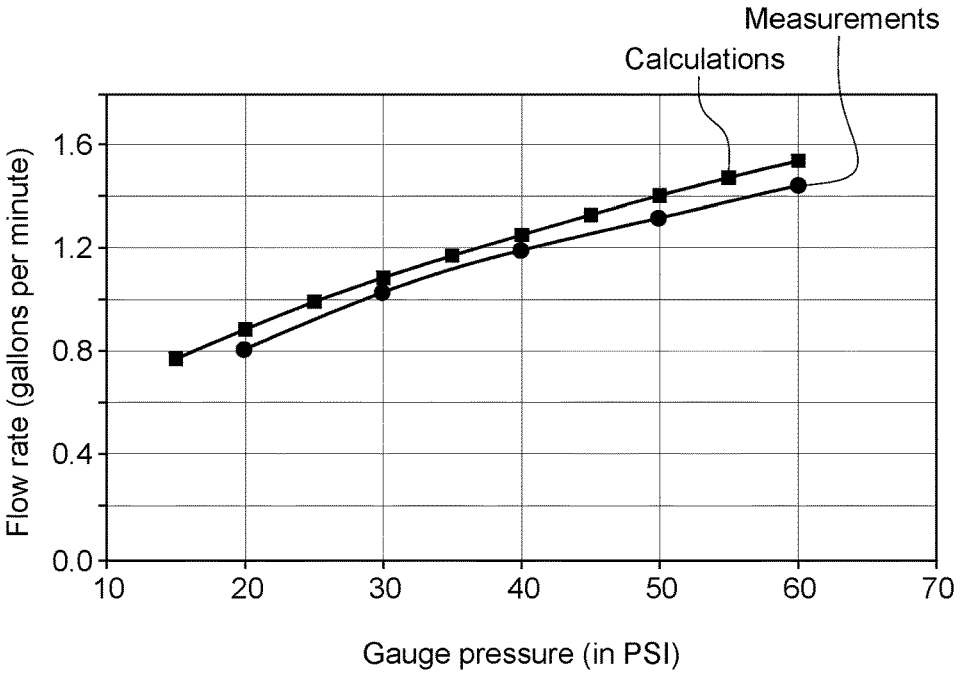
FIG. 7 is a graph comparing nozzle flow rates of fluid at various supply pressures.
Figure 8:
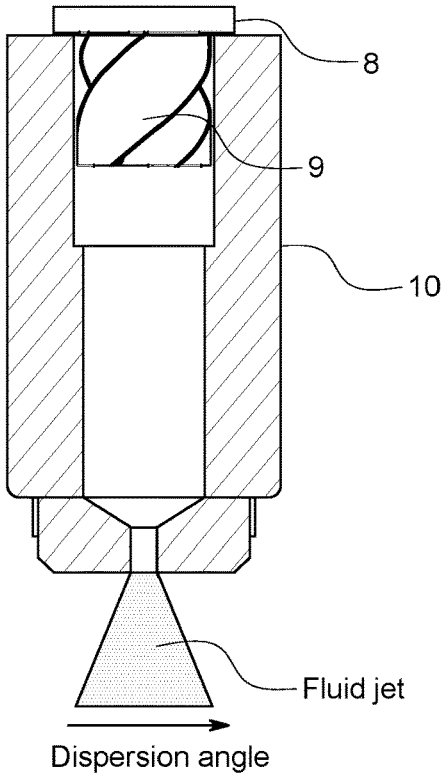
FIG. 8 shows an example of nozzle test configuration.

For the shower head to meet water conservation requirements, a splash nozzle that yields lower mass flow rates was designed. The estimated flow rates and the measured flow rates from such a splash nozzle are compared in FIG. 7. As can be seen the design estimates and the test measurements of the flow rates from the designed splash nozzles agree very well, thus establishing the desired splash nozzle configuration for our application in this invention. As can also be seen, the nozzle delivers the desired flow rates consistent with conservation of fluids. FIG. 8 shows an example of nozzle test configuration used to obtain the data presented in FIG. 7. FIG. 8 indicates an example of fluid jet exiting the nozzle with an example of dispersion angle.

The splash vanes, by virtue of their geometry, impart rotational motion to the fluid in the nozzle. The rotational motion of the fluid imparted by the vane in the nozzle changes the flow properties of the exiting jet from a long cylindrical string-like laminate form to a conical shaped jet. Some of these conical forms comprise a full cone jet wherein at every cross section of the full conical jet is filled by the droplets. Other forms include hollow conical jets. The droplets from the hollow cone jets display a ring-like form where all the droplets exiting from the splash nozzle are concentrated at the periphery of the jet forming a dense ring of droplets with none in the middle of it.

The droplets from full cone jets are larger than those from hollow cone jets. As such, the hollow cone jets yield a greater number of droplets for a given mass flow of the jets and are capable of wetting a larger surface area for showering purposes compared to a full cone jet. In view of that a hollow cone nozzle was chosen to meet the goals set for the present invention.

The approach here is to define a variable geometric property of a splash vane and investigate qualitatively its influence on the flow properties like the dispersion angle of the flow from the splash nozzle and the droplet particle size. An option for the splash vane design comprising a variation of the inlet flow area of vane opening at entrance of the nozzle was chosen. Such an approach gives the designer an ability to control the flow at the vane inlet of the splash nozzle and investigate its influence on the flow properties of the exit jet like the dispersion angles of the jet, droplet heat transfer and impingement properties qualitatively.

Such designs not only control the inlet mass flow of water but also the angle of entrance and the exit angle of flow into the nozzle. Several splash vanes were designed with different vane opening areas and identical flow entrance and exit angles for the flow to enter and exit the splash nozzle. These splash vanes were inserted into identical splash nozzles and tested at a chosen design pressure of the shower head. A test bed shower head with plurality of holes to accommodate one to six splash nozzles at any given time was used. These test splash nozzles with designed splash vanes were installed in the test bed shower and tested to measure the dispersion angles of the exit jets. Such a test setup eliminates the deviations in the test conditions from one splash vane to the other.

Figure 9:
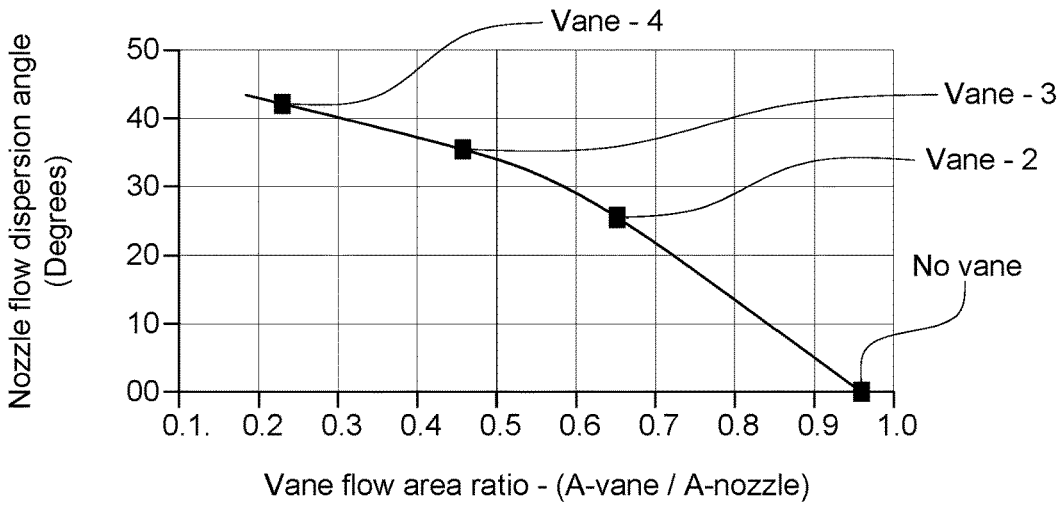
FIG. 9 is a graph of dispersion angle vs. vane flow area ratio.
Figure 10A:
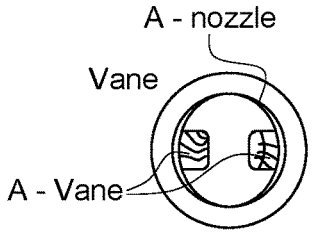
FIG. 10A-10C show experimental vane configurations; vane—4, vane—3, and vane—2, respectively.
Figure 10B:
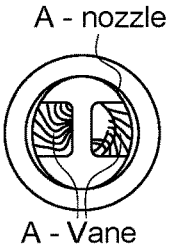
Figure 10C:
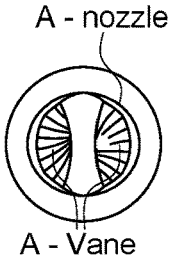

Qualitative results of some of these tests at design pressure are presented in FIG. 9 The graph shows that the dispersion angle of the exiting fluid jet increases with the decrease of the vane opening areas. FIGS. 10A-10C show the respective splash vane configurations used in these tests. The plot of FIG. 9 shows the variation of the dispersion angle of the exiting jets as a function of the non-dimensional geometric parameter of the ratio of total area of all vane openings of the splash vane, A-vane, to that of the nozzle inlet area (cross sectional area of the vane chamber of the nozzle) A-nozzle. FIG. 10A shows the configuration with the smallest area ratio of A-vane/A-nozzle tested, FIG. 10B a medium area ratio of A-vane/A-nozzle, and FIG. 10C the largest area ratio of A-vane/A-nozzle tested. These results are purely qualitative; by that the absolute values may not be exact while the trends are indicative of the proper direction of the effect of variation of the chosen parameter and can be very useful to the designer.

These results indicate that the fluid jet dispersion angle widens with the decrease of the flow inlet area; thereby the inlet mass flow. It further shows that the large area ratio vanes yield full cone fluid jets whereas the smaller area ratio vanes resulted in hollow cone fluid jets. This is a significant finding as it indicates that with appropriate measurable changes to the geometry of the splash vanes in a systematic fashion (in this invention flow inlet areas were changed— this in turn changed the inlet mass flow through the vane opening) one can generate a class of jets varying from a full cone fluid jets to hollow cone fluid jets. The interesting feature here is that the geometry of the splash nozzle and its flow rates were unchanged while the character of the exit jet was dramatically changed from one class of jets to a significantly different class of another ones. These results strongly indicate that the hollow cone fluid jets are a subset of full cone fluid jets. Further tests indicated that increasing the swirl flow path rotation also yields hollow cone fluid jets. Implementation of such higher swirl flow path rotation lengthens the vane. With the aid of this information the designer can design the same class of splash vanes and splash nozzles to meet the desired requirements of their applications.

The splash vanes described herein were designed with the aid of the information from the above independent investigation. The splash vane embodiments shown in FIG. 11B and FIG. 11D comprise the following parts: vane blocker 41, flow boundary walls 42, swirling flow path 43, flow boundary wall thickness 44, swirling flow path width 45, vane height with no retaining ring 46, vane height with retaining ring 47, flow entrance angle 48, flow exit angle 49, vane opening 50, vane axis 51 and the retaining ring 8.

Figure 11A:
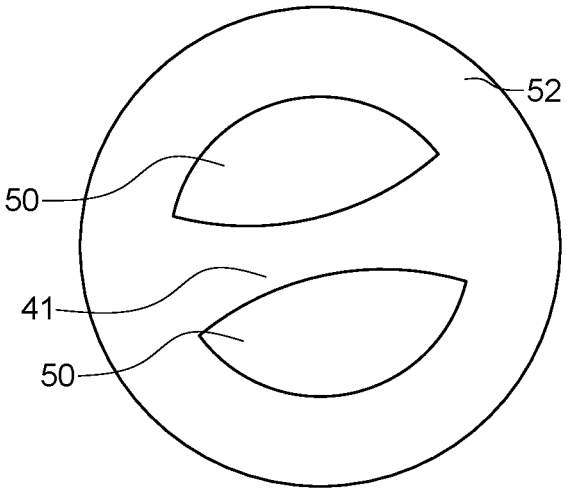
FIG. 11A is a plan view of an embodiment of the splash vane with a retaining ring.
Figure 11B:
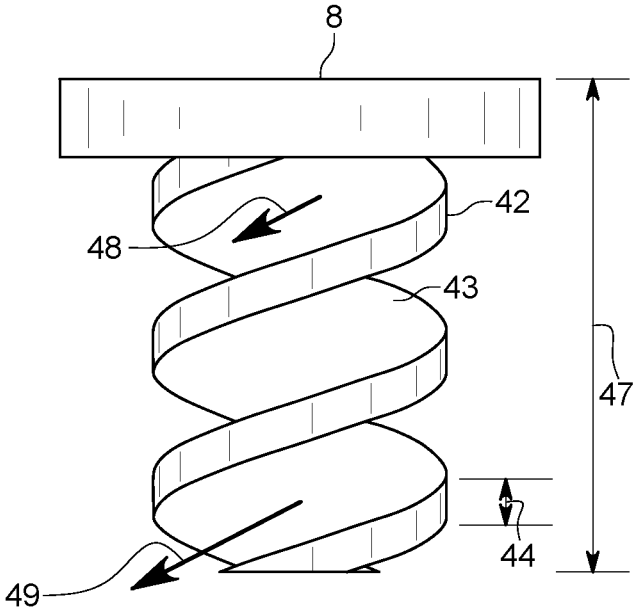
FIG. 11B is an elevation view of an embodiment of the splash vane with retaining ring.
Figure 11C:
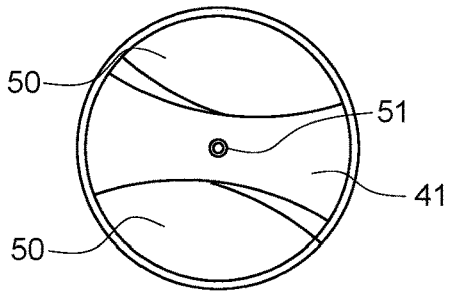
FIG. 11C is a plan view of an embodiment of the splash vane without a retaining ring.
Figure 11D:
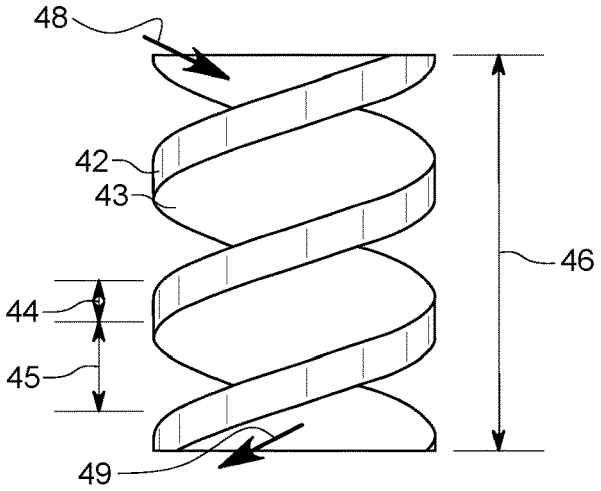
FIG. 11D is an elevation view of an embodiment of the splash vane without retaining ring.

FIGS. 11A 11C show splash vane configuration plan views with two vane openings 50 at the top of the vane for the fluid entrance. A vane blocker 41, separates the two openings. The splash vane comprises a continuous flow boundary wall 42, encircling a solid body in the center of it. In this design the solid body is the vane blocker of the nozzle. The swirling flow paths 43, in the splash vane was created by rotating the vane blocker by a small angle around the vane axis 51 (the central longitudinal axis of the vane), of the splash vane and traversing it; up or down; simultaneously along the same axis. This process was repeated in a continuous circular manner from one angular position to another and connecting the corresponding points or lofting in a three dimensional domain from one position to another of the vane blocker.

The swirling flow path is the encircling cavity formed in the splash vane in between the adjacent flow boundary walls 42, which accommodates the flow of fluid entering the vane opening at the top of the splash vane to its exit. The swirling flow path 43, guides the fluid flow from the entrance at the top of the splash vane to exit at its bottom. The inner walls of the vane chamber of the nozzle form the outer enclosing boundary of the splash vane to contain the fluid flow in its swirling flow path. In the splash vane shown in FIG. 11B and FIG. 11D there are two swirling flow paths to accommodate the flow from the two vane openings at the top. These two swirling flow paths oppose one another with respect to the central longitudinal axis about which they each revolve. The encircling flow boundary wall thickness 44, is designed to be uniform from top to bottom. It can be designed to vary in thickness with no appreciable changes to the performance of the splash vane. The distance between the two flow boundary walls; the swirling flow path width 45, is maintained at constant width from top to bottom. In embodiments, the ratio of flow boundary wall thickness 44 to swirling flow path width 45 is between about 0.3 to 1.0, inclusive.

These two properties of the splash vane namely the thickness of the flow boundary wall 44, and the distance between the two flow boundary walls, the swirling flow path width 45, are defined by the rotation angle and the traversing distance of the vane blocker around and along the axis 51, which can be varied and scaled to make them non uniform. The height of the splash vane 46 and 47, and the turning of the flow from entrance position at the top of the splash vane to its bottom are determined by the rotation angle and traverse of the vane blocker. The longer the traverse, the taller the splash vane height. Higher the rotation angle, the larger the entrance and exit angles 48 and 49 of the fluid. The splash vane can be made to turn the fluid in the nozzle as many turns as one wants. By the same token they also can be made as long or short as one needs. The height of the splash vane (including retaining ring, if present) relative to the nozzle internal height (defined as the total height of the vane chamber 23, swirling chamber 24, and flow contraction area 28) may be varied to control the shape of the fluid jet exiting the nozzle. In embodiments, a ratio of splash vane height to nozzle internal height is between about 0.2 and 0.7. In one embodiment, a ratio of splash vane height to nozzle internal height of less than 0.5 provides a fluid jet having the shape of a full cone. In another embodiment, a ratio of splash vane height to nozzle internal height between about 0.5 and 0.75 provides a fluid jet having the shape of a hollow cone.

The splash vane of the FIG. 11B embodiment is fitted with a retaining ring 8, at the top. The purpose of the retaining ring is to extend the length of the nozzle. It should be noted that the splash vane without a retaining ring (FIG. 11D) is a component of the splash vane with retaining ring. One may opt to have a splash vane without a retaining ring, also with no appreciable changes to its performance.

FIGS. 12 and 13 show a splash nozzle and splash vane assembly with and without a retaining ring, respectively. The designed step in the vane chamber of the nozzle shall provide the seating for the splash vane without a retaining ring and it will be quite satisfactory for all applications. As can be seen in FIG. 13, the splash vane without a retaining ring sits firmly on the vane stopper 29. In FIG. 12, the splash vane with retaining ring sits on the top of the splash nozzle holding the splash vane in place in the vane chamber of the nozzle. The retaining ring was designed not to hinder the assembly of the splash nozzle with the nozzle holding plate of the shower head. The water inlet at vane openings for the fluid to enter the nozzle is shown in these figures. The above shown assembly of splash nozzle with splash vane shall be securely fastened to the nozzle holding plate of the shower head to dispense the water from the supply tank to bather.

Figure 14:
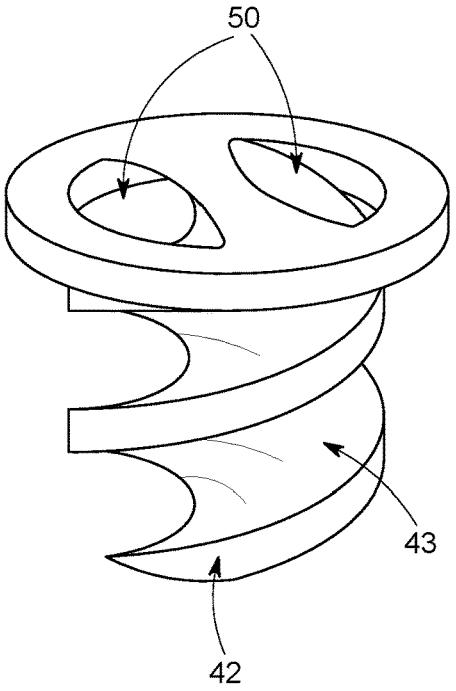
FIG. 14 shows an embodiment of a vane configuration with two vane openings and swirling flow paths.
Figure 15:
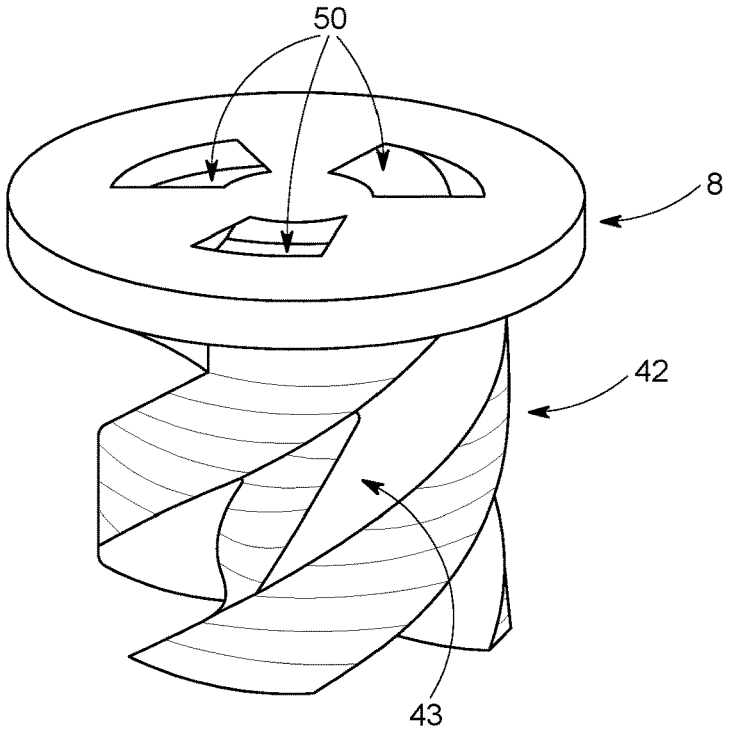
FIG. 15 shows an embodiment of a vane configuration with three vane openings and swirling flow paths.
Figure 16:
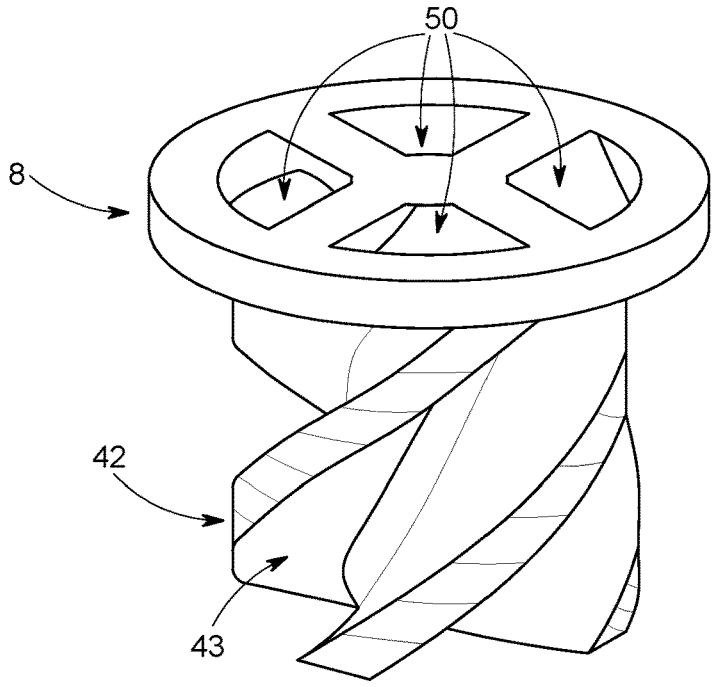
FIG. 16 shows an embodiment of a vane configuration with four vane openings and swirling flow paths.

Further it may be instructive to note that splash vanes with a plurality of openings can be devised to suit ones purpose. FIGS. 14, 15, and 16 present perspective views of embodiments of the splash vane with different configurations of the shape of vane opening 50 and number of flow paths. FIGS. 14, 15, and 16 show three such example splash vane geometries with the number of vane openings 50 varying from two to four (inclusive), however, these examples in no way imply that there cannot be more than four vane openings. As a matter of fact, space permitting, a plurality of vane openings can be accommodated as one desires. The swirl flow paths so developed from each vane openings shall be distinct and separate. The shape of the vane openings in cross-section, as seen in FIGS. 14, 15, and 16, may be substantially ovoid, trapezoidal, or frustoconical, respectively, although other geometries may also be used. Furthermore, although the vane opening geometries shown are partially defined by the boundary with retaining ring 8, it is to be understood that, in the absence of a retaining ring, the vane openings will be similarly bounded by the nozzle inner wall, thereby having substantially the same shape.

These splash vanes can be designed to effect a plurality of flow properties. These geometrical variations can be scaled to make these configurations shorter, longer with as much of swirl or rotations as one desires. In embodiments, the flow paths complete between 0.5 to 3 revolutions about the central longitudinal axis. While these geometrical variations of the splash vane have a significant effect on the flow properties of the exit jets from the nozzle, the exit angle of the flow from such changes has considerable effect on the impact force of the exit jets for shower applications. By managing the rotation angle and traversing distance of the blocker one can make the fluid entrance angle much lower; to contain the entrance losses; and at the same time the exit angle can be made very large to reduce the impact force of the droplets from the exit jet.

These unique splash vanes were installed in the splash nozzles used in the shower head. The splash vanes when inserted into the splash nozzle fit snugly into their vane chamber. Such unique splash vane-splash nozzle embodiment incorporated into the splash spray shower head made it a unique shower device.

It should be noted here that the swirling flow paths in the splash vane configurations shown in this investigation are laid out in a clockwise direction. As such the flow in the vane swirl chamber rotates in clockwise direction. They can just as well be laid out in anticlockwise direction making the flow rotate in anticlockwise direction in the swirl chamber of the splash nozzle with no change in their performance.

Figure 17A:
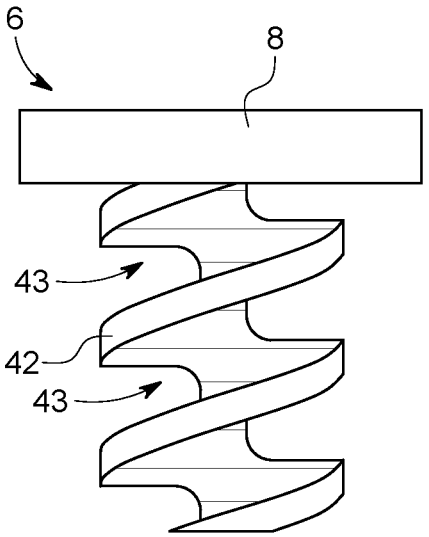
FIG. 17A is an elevation view of an embodiment of a splash vane.
Figure 17B:
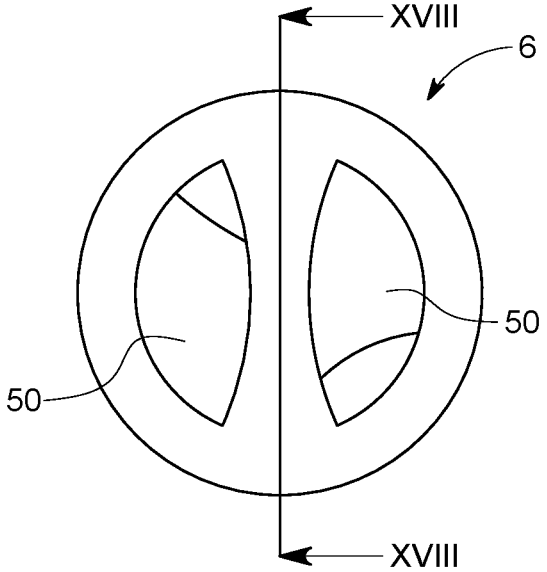
FIG. 17B is a plan view thereof.
Figure 18:
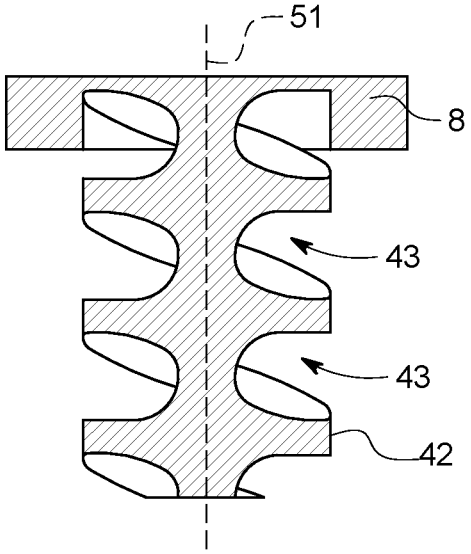
FIG. 18 is a cross-sectional view along line XVIII-XVIII of FIG. 17B.

FIGS. 17 and 18 show the cross sections and elevations of the splash vane with and without retaining ring. The plane of rotation and plane of cross sections are also presented in the FIGS. 17 and 18. Visually the figures show how the two flow boundary walls and the swirling flow paths are formed. These sets of flow boundary walls and the swirling flow paths are designed to be distinct, separate and parallel. As an example, the figures show that the vanes rotate the flow entering from both of their vane openings 50 at the splash nozzle entrance by more than 270 degrees before it exits the vane chamber of the splash nozzle.

Figure 19:
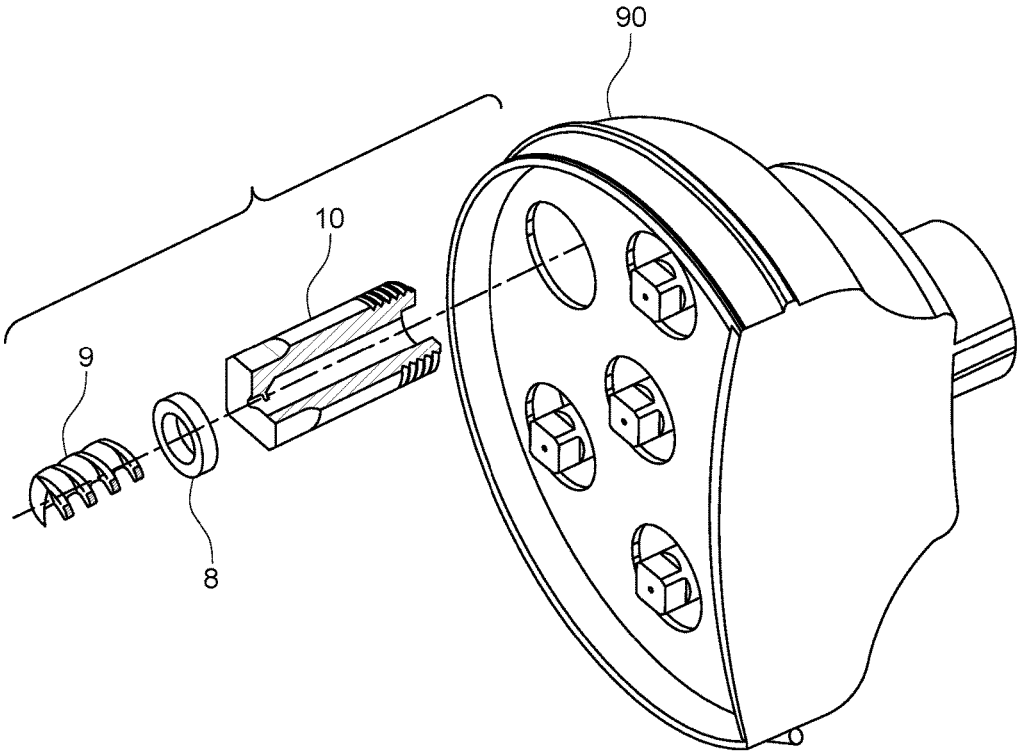
FIG. 19 is an exploded perspective view of an embodiment of a shower head with splash vane.

FIG. 19 shows an exploded perspective view of the splash spray shower head 90, along with the splash nozzle 10, retaining ring 8 and the splash vane 9. While a configuration may or may not include the retaining ring 8 in its assembly and operation, the parts 90, 10, and 9 are essential for the operation of the splash spray shower head. It is an understatement to say that without the splash vane 9, the heart of the operation, the splash spray shower head 90 cannot operate the way it is intended to be.

Figure 20:
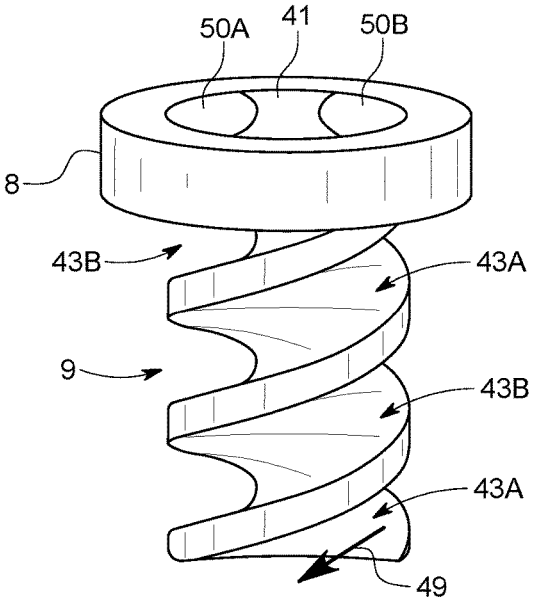
FIG. 20 is a perspective view of an embodiment of the splash vane with retaining ring.

FIG. 20 shows a three dimensional view of a splash vane 9. The figure shows the encircling flow boundary walls and the swirl flow paths. Two flow paths are distinguished in the figure with reference numbers 43A and 43B, where fluid enters path 43A through vane opening 50A and fluid enters path 43B through opening 50B. The figure also shows the three dimensional view of the splash vane with details of the geometry and the flow path definition. The unique splash vane with its distinct and separate flow path definitions without retaining ring was presented in this figure. As stated earlier the splash vane sits in the nozzle vane chamber snugly. Flow enters the vane openings on the left and right sides of the splash vane, traverses around in the swirling flow path tangential to the inner wall of the splash nozzle and exits from the two fluid outlets of the splash vane at its bottom and enters the swirl chamber of the splash nozzle. These said two flows rotate in the same direction; clock wise direction in our application here; in the swirl chamber and complement each other in motion. The fluid in the swirl chamber is three dimensional with large components of velocities in the tangential and axial directions. The presence of large tangential component of velocity in the flow renders the exiting fluid to exit as conical jets with various dispersion angles depending on the inlet pressure of the fluid entering the splash nozzle and splash vane assembly.

In summary, it is the combination of the plurality of splash nozzles comprising a vorticity generating element and an atomizing element with or without a retaining ring that makes these splash spray shower heads provide a shower of fluid droplets of desired diameter with low heat loss over a large area of the body to wash off efficiently in a warm comfortable environment with as little an amount of water as is possible.

These embodiments of a splash vane, a vorticity generating element and an atomizing element, are unique and different in purpose and performance and are one of a kind with its unique capability of generating a class of jets comprising full cone jets to hollow cone jets with a measured change of the splash vane inlet opening geometry.

While the preceding narration describes our invention in significant detail, it is by no means an exhaustive examples of the possible embodiments encompassing the full range of applications and variations of this invention. The informed and skilled in the art will realize that many other forms, variations and applications of the splash vane depicted in FIG. 11A, FIG. 11B, FIG. 11C, and FIG. 11D with and without the retaining ring, are possible. For example the increase or decrease of the splash vane height 46, 47 can and will lead to dramatic change in the properties of the exit jet from the splash nozzle, that will find its way to more efficient applications in other areas like agriculture and cleaning applications besides the bath system applications.

A demonstrated example of significant variation of the flow properties of the jets exiting from the splash nozzles is presented in FIG. 9. The figure shows that by varying vane opening area 50, the flow rates into the splash vane, and thereby into the splash nozzle, are limited, and the dispersion angle of the exiting jets from the splash nozzle changes dramatically. This in turn changes the droplet size of the flow as well as the character of the jets itself from full cone jets to hollow cone jets.

Another example of importance is to investigate the effect of splash vane configuration with a plurality of vane openings 50 as shown in FIG. 10. Those skilled in the art shall realize many other significant embodiments besides what is presented here within the scope of this invention. Some of the shower head embodiments described herein have flow rates between 0.8 and 1.6 gallons per minute (GPM). In one exemplary embodiment, the flow rate from each nozzle at 40 psi is about 0.22 GPM. In a five nozzle shower head, the total flow rate is around 1 GPM.

One could also choose a design, for example, to vary the number of rotations of the swirling fluid flow in the vane chamber of the splash nozzle by varying the geometrical design of the swirling flow paths 43 and the flow boundary walls 42 of the splash vane to alter the properties of the exiting fluid jets from the splash nozzles within the inventive scope of this invention.

I claim:

1. A vane for cooperation with a nozzle of a shower head, the vane comprising:

a substantially cylindrical body having a central longitudinal axis extending along a length from a top face to a bottom face;

a vane blocker centered about the central longitudinal axis, having a cross-sectional profile across an entire area of the vane blocker orthogonal to the central longitudinal axis, the vane blocker shaped as the cross-sectional profile rotated about the central longitudinal axis in a helical path along the entire length of the body from the top face to the bottom face, and having a plurality of helical flow boundary walls; and, a plurality of flow paths defined by the flow boundary walls, each flow path having vane openings at both the top face and the bottom face configured for fluid to flow therebetween in a swirling path around the central longitudinal axis, the vane openings of each flow path being separate and distinct from the vane openings of each of the other flow paths as viewed from both the top face and the bottom face.

2. The vane of claim 1, wherein the flow boundary walls define from two to four flow paths.

3. The vane of claim 1, wherein each of the vane openings has a substantially ovoid shape in the cross-sectional profile.

4. The vane of claim 1, wherein each of the vane openings has a substantially trapezoidal shape in the cross-sectional profile.

5. The vane of claim 1, wherein each of the vane openings has a substantially frustoconical shape in the cross-sectional profile.

6. The vane of claim 1, wherein each of the plurality of flow paths completes between 0.5 to 3 revolutions about the central longitudinal axis.

7. The vane of claim 1, wherein the ratio of a thickness of the flow boundary walls to a path width between adjacent flow boundary walls is between about 0.3 and 1.0.

8. A nozzle for a shower head, the nozzle comprising:

a substantially cylindrical nozzle body having a hollow central bore bounded by a nozzle inner wall and opening to a flow entrance and a nozzle exit, the central bore having a vane chamber, a swirling chamber, and a flow contraction area in fluid communication between the flow entrance and the nozzle exit;

a vane positioned within the vane chamber, the vane having:

a substantially cylindrical vane body shaped and dimensioned to be closely received by the vane chamber, the vane body having a central longitudinal axis extending along a length from a top face to a bottom face;

a vane blocker centered about the central longitudinal axis, having a cross-sectional profile across an entire area of the vane blocker orthogonal to the central longitudinal axis, the vane blocker shaped as the cross-sectional profile rotated about the central longitudinal axis in a helical path along the entire length of the vane body from the top face to the bottom face, and having a plurality of helical flow boundary walls; and, a plurality of flow paths defined by the flow boundary walls and the nozzle inner wall, each flow path having vane openings at both the top face and the bottom face configured for fluid to flow therebetween in a swirling path around the central longitudinal axis, the vane openings of each flow path being separate and distinct from the vane openings of each of the other flow paths as viewed from both the top face and the bottom face.

9. The nozzle of claim 8, wherein:

the vane chamber is directly adjacent to the swirling chamber;

the vane chamber has a vane chamber diameter and the swirling chamber has a swirling chamber diameter smaller than the vane chamber diameter; and, the nozzle inner wall having a vane stopper where the vane chamber adjoins the swirling chamber, the vane stopper configured to contact and retain the bottom face of the vane.

10. The nozzle of claim 8, further including:

a nozzle area bounded by the nozzle inner wall at the flow entrance;

a vane flow area defined as the difference between the nozzle area and an area of the vane blocker in the cross-sectional profile; and, wherein the ratio of the vane flow area to the nozzle area is between 0.2 and 0.7.

11. The nozzle of claim 8, wherein:

a ratio of a height of the splash vane to a nozzle internal height is between 0.2 and 0.7.

12. A shower head comprising:

a plurality of nozzles, each including:

a substantially cylindrical nozzle body having a hollow central bore bounded by a nozzle inner wall and opening to a flow entrance and a nozzle exit, the central bore having a vane chamber, a swirling chamber, and a flow contraction area in fluid communication between the flow entrance and the nozzle exit;

a vane positioned within the vane chamber, the vane having:

a substantially cylindrical vane body shaped and dimensioned to be closely received by the vane chamber, the vane body having a central longitudinal axis extending along a length from a top face to a bottom face;

a vane blocker centered about the central longitudinal axis, having a cross-sectional profile across an entire area of the vane blocker orthogonal to the central longitudinal axis, the vane blocker shaped as the cross-sectional profile rotated about the central longitudinal axis in a helical path along the entire length of the vane body from the top face to the bottom face, and having a plurality of helical flow boundary walls; and, a plurality of flow paths defined by the flow boundary walls and the nozzle inner wall, each flow path having vane openings at both the top face and the bottom face configured for fluid to flow therebetween in a swirling path around the central longitudinal axis, the vane openings of each flow path being separate and distinct from the vane openings of each of the other flow paths as viewed from both the top face and the bottom face.

13. The shower head of claim 12, further including:

a fluid inlet leading to an internal supply tank bounded by a nozzle holding plate, the nozzle holding plate having an external perimeter in the shape of a portion of a circle.

14. The shower head of claim 13, wherein the nozzle holding plate is integrally formed with a shower head body.

15. The shower head of claim 12, including from three to six nozzles.

16. The shower head of claim 12, wherein the nozzles are configured for a total flow rate of between 0.8 and 1.6 gallons per minute.

* * * * *